US007683254B2

(12) United States Patent
Shimizu

(10) Patent No.: US 7,683,254 B2
(45) Date of Patent: Mar. 23, 2010

(54) ELECTRICAL JUNCTION BOX INCORPORATING AN ELECTRONIC COMPONENT AND ELECTRICAL CONNECTION UNIT HAVING THEREOF

(75) Inventor: Tomohiko Shimizu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/292,514

(22) Filed: Nov. 20, 2008

(65) Prior Publication Data

US 2009/0139741 A1 Jun. 4, 2009

(30) Foreign Application Priority Data

Nov. 29, 2007 (JP) ..... 2007-308188

(51) Int. Cl.
*H05K 5/02* (2006.01)

(52) U.S. Cl. ..... 174/51; 174/6; 174/40 CC; 174/78; 439/98; 361/799

(58) Field of Classification Search ..... 174/6, 174/51, 135, 40 CC, 78; 439/98, 100, 101, 439/92; 361/799, 753
See application file for complete search history.

(56) References Cited

U.S. PATENT DOCUMENTS 6,129,565 A * 10/2000 Lai ..... 439/101
6,369,323 B1 * 4/2002 Wright ..... 174/51
6,403,880 B1 * 6/2002 Elford et al. ..... 174/51
7,056,161 B2 * 6/2006 Delcourt et al. ..... 439/766

FOREIGN PATENT DOCUMENTS

JP 2006-100061 4/2006

* cited by examiner

*Primary Examiner*—Dhiru R Patel
(74) *Attorney, Agent, or Firm*—Edwards Angell Palmer & Dodge LLP

(57) ABSTRACT

An electrical connection unit includes an electrical junction box that incorporates a capacitor and has (a) a body that has an electronic component accommodating space accommodating the capacitor via an opening; and an electric wire receiving space receiving an electric wire electrically connected to a terminal of the capacitor, and (b) an electrically conductive grounding member that grounds a grounding terminal of the capacitor and integrally includes: a connecting portion electrically connected to the grounding terminal; a cover portion covering the opening of the electronic component accommodating space; a locking to be locked with corresponding locking portions of the body; a bending preventing portion preventing inward bending one of the locking portions of the body which may cause one of the locking portions of the grounding member to be accidentally detached from the corresponding locking portion of the body; and a grounding portion.

4 Claims, 7 Drawing Sheets

ELECTRICAL JUNCTION BOX INCORPORATING AN ELECTRONIC COMPONENT AND ELECTRICAL CONNECTION UNIT HAVING THEREOF

CROSS REFERENCE TO RELATED APPLICATION

The priority application Japan Patent Application No. 2007-308188 upon which this patent application is based is hereby incorporated by reference.

DESCRIPTION OF THE RELATED ART

1. Field of the Invention

The present invention generally relates to an electrical connection unit that includes an electrical junction box incorporating an electronic component, and, in particular, to an electrical junction box that accommodates therein an electronic component and receives a portion of an electric wire for ground connection.

2. Description of the Related Art

Automotive sensors may malfunction due to noise that travels through an electric wire. Electric noise generated by various noise sources that have a high frequency component such as a horn and a windshield wiper motor, exogenous noise from a neon sign, and induction noise have undesirable, disruptive effects upon the automotive sensors.

An automotive wiring harness has an electric wire dedicated to ground connection which is connected via a capacitor to a body of an automobile. As one example of known anti-noise measures of this kind, Japanese Patent Application Laid-Open Publication 2006-100061 discloses an electrical connector with a built-in capacitor for grounding a predetermined electric wire via the capacitor.

The electrical connector of Japanese Patent Application Laid-Open Publication 2006-100061, with a simple and compact structure, employs the conventional built-in capacitor with a pair of terminals that protrude from a main body of the capacitor in a same direction. It is via the built-in capacitor that a terminal of an electric wire is grounded.

The above conventional electrical connector with a built-in capacitor has drawbacks. The built-in capacitor is received in a housing made of synthetic resin via an opening, a cover is attached to the housing to close the opening of the housing, and then the cover is locked with the housing by a locking mechanism. Since the locking mechanism is exposed to an outside of the electrical connector, the cover may be accidentally removed from the housing when an external force acts upon the locking mechanism. In addition, ground connection and therefore anti-noise measure fail to work when the capacitor is demounted as a result of accidental removal of the cover from the housing.

The accidental removal of the cover and demounting of the built-in capacitor are not specific to the electrical connector with a built-in capacitor and can happen to an electrical junction box incorporating therein a capacitor or any other type of electronic components.

SUMMARY OF THE INVENTION

It is therefore an object of the present invention to provide an electrical junction box incorporating therein an electronic component and an electrical connection unit having thereof, with simple configuration, capable of effectively preventing electrical disconnection.

In order to address the above identified objectives, the electrical junction box incorporating an electronic component according to one embodiment of the present invention includes a body that has an electronic component accommodating space and an electric wire receiving space, and an electrically conductive grounding member that grounds a grounding terminal of the electronic component. The electronic component accommodating space is configured to accommodate an electronic component in an inside thereof via an opening. The electric wire receiving space is configured to receive a portion of an electric wire that is electrically connected to a terminal of the electronic component that has been accommodated in the electronic component accommodating space. The grounding member has in one piece therewith a connecting portion that is electrically connected to the grounding terminal of the electronic component, a cover portion that closes the opening of the electronic component accommodating space, a locking portion that is locked with a corresponding locking portion of the body such that the cover portion is locked with the body, a bending preventing portion that prevents the locking portion of the body from bending in a detachment direction in which the locking portion of the grounding member is detached from the locking portion of the body, and a grounding portion that is secured to a mating component of an automobile so as to ground the connecting portion.

With the construction and arrangement described above, accidental exit from a state of locking between the locking portion of the body and the locking portion of the grounding member can be effectively prevented even when the locking portions of the grounding member and the unit are acted upon by an external force. In addition, by using the grounding member made of an electrically conductive metal, mechanical strength can be imparted to the bending preventing portion, and thus countermeasure against the accidental exit will be more effective. This improves not only reliability of mechanical locking mechanism but also reliability of electrical connection of the electrical junction box. Elimination of accidental removal of the grounding member from the body due to the external force acting upon the locking mechanism makes it possible to effectively prevent electrical disconnection among the grounding member, the electronic component, and the electric wire due to the external force.

Preferably, the electrical junction box incorporating an electronic component according to the present invention may further include a mounting unit detachably attached to the cover portion of the grounding member and configured to lock the body with the mating component of the automobile, and a mounting hole formed on the cover portion of the grounding member. The mounting unit is detachably mounted to the mounting hole at a stage where the opening of the electronic component accommodating space is yet to be closed. After the opening of the electronic component accommodating space has been closed, the mounting hole makes the mounting unit abut against the electronic component accommodating space so as to prevent the body from being detached from the grounding member engaged with the mounting unit.

With the construction and arrangement described above, the mounting unit is detachably attached to the mounting hole of the cover portion of the grounding member. Also, in spite of such detachable attachment of the mounting unit to the mounting hole, the mounting unit is configured to abut against the electronic component accommodating space so as to prevent the body from accidentally detached from the grounding member once the body has been locked with the grounding member, i.e., after the opening of the electronic component accommodating space of the body has been covered by the cover portion of the grounding member. Thus, assembly operation of the electrical junction box can be made more efficient.

Preferably, the body of the electrical junction box has a guiding portion that guides the locking portion of the grounding member to the locking portion of the body, and the grounding member has an abutting portion that abuts against the guiding portion when the locking portion of the grounding member is locked with the locking portion of the body.

With the construction and arrangement described above, the failure to lock the grounding member with the body can be prevented. Also, since the grounding member has the abutting portion configured to abut against the guiding portion, rattling of the grounding member while the electrical junction box is in use can be avoided. Thus, the reliability of locking mechanism and the reliability of electrical connection are both further improved, and strange or unusual sound due to vibration while the automobile is moving can be effectively prevented.

Preferably, the bending preventing portion of the grounding member allows the locking portion of the body 27 to resiliently bend in the detachment direction until the locking portion of the body is locked with the locking portion of the grounding member, and prevents the locking portion of the body from resiliently bending in the detachment direction after the locking portion of the body has been locked with the locking portion of the grounding member.

With the construction and arrangement described above, further efficiency in the assembly operation of the electrical junction box can be achieved by virtue of the locking portion of the body capable of resiliently bending in the detachment direction before complete locking between the locking portions of the body and the grounding member, and preventing resilient bending of the locking portion in the detachment direction once the complete locking has been achieved.

In order to address the above identified objectives, the electrical connection unit according to the present invention includes: the electrical junction box which has been sketched in the foregoing and will be described more in detail in the following description of this specification; an electronic component which is accommodated in the electronic component accommodating space of the electrical junction box; an electric wire a portion of which is received in the electric wire receiving space and is grounded via the electronic component and the grounding member.

Objects and advantages that have been explicitly mentioned in the foregoing can be equally achieved by this electrical connection unit. Further objects, features, and advantages will become more apparent upon reading of the following detailed description along with the accompanied drawings, and will be obvious from the description or may be learned by practice of the invention.

DESCRIPTION OF THE PREFERRED EMBODIMENT

An electrical connection unit including an electrical junction box that incorporates an electronic component according to one embodiment of the present invention is described below with reference to FIGS. 1 to 9.

Figure 1:
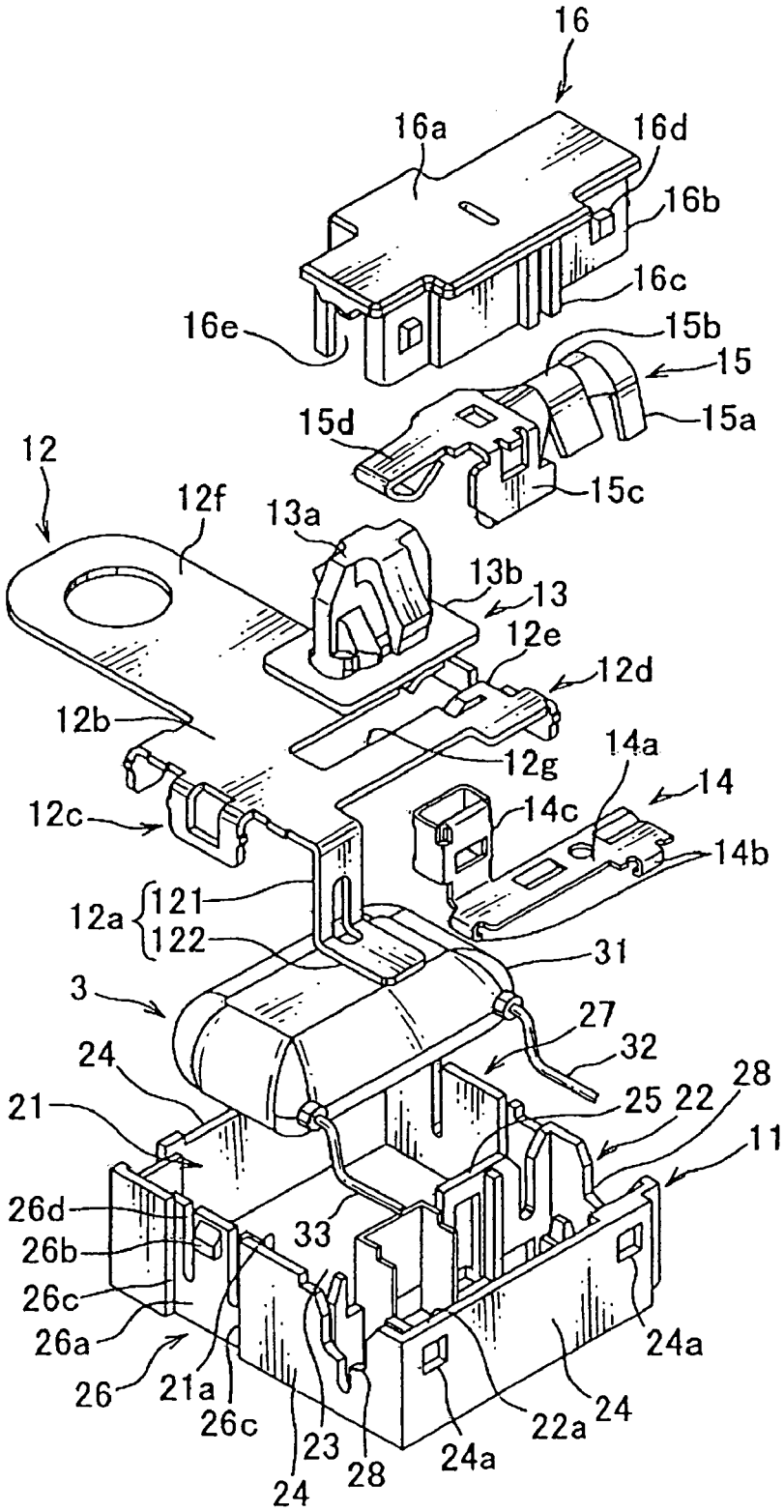
FIG. 1 is an exploded perspective view of an electrical connection unit incorporating an electrical junction box incorporating an electronic component according to one embodiment of the present invention.
Figure 2:
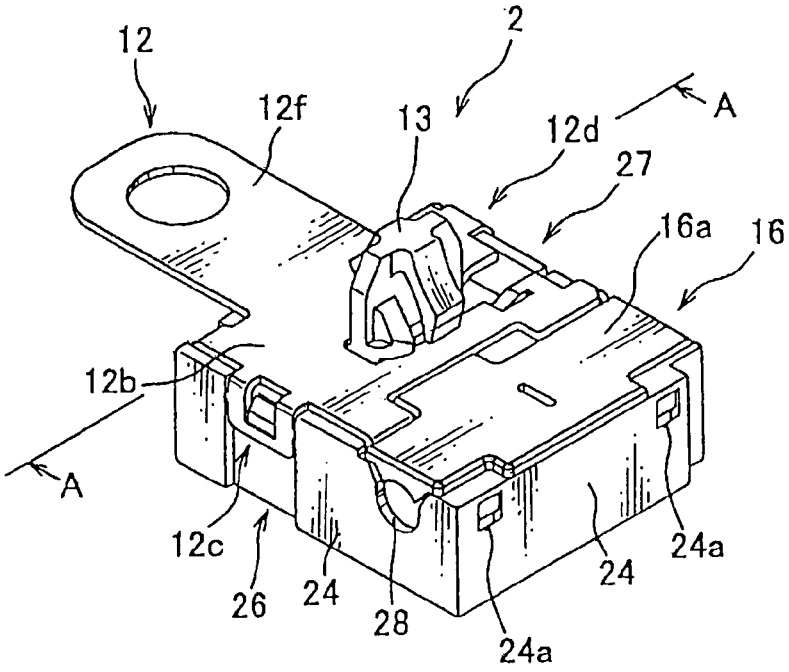
FIG. 2 is a perspective view of the electrical junction box incorporating an electronic component of FIG. 1.
Figure 3:
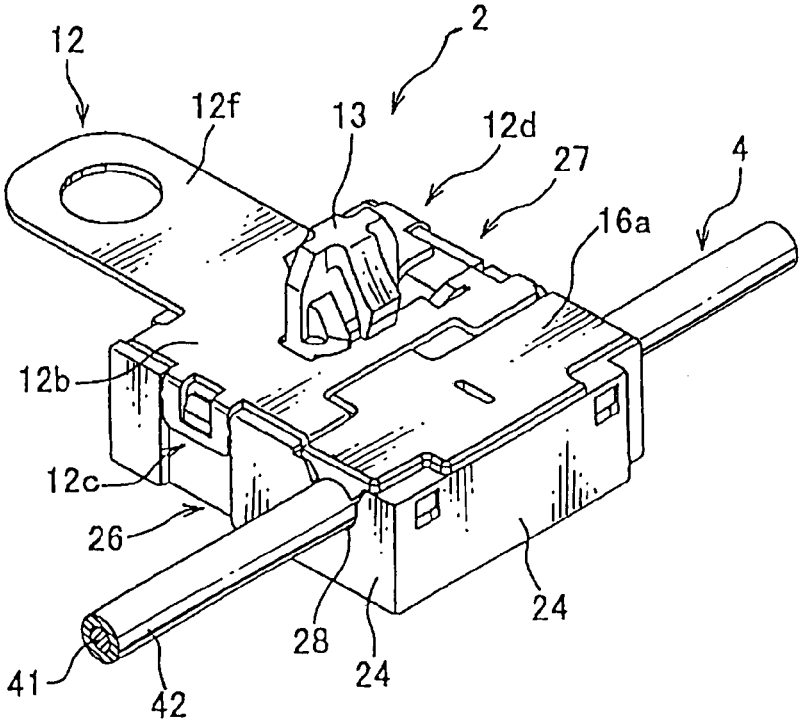
FIG. 3 is a perspective view of the electrical connection unit incorporating the electrical junction box incorporating an electronic component of FIG. 1.

Referring to FIGS. 1 to 3, the electrical connection unit includes (a) the electrical junction box (hereafter simply called "junction box 2"), (b) a capacitor 3 as the electronic component that is to be accommodated in an electronic component accommodating space 21 of the junction box 2, and (c) an electric wire 4 a portion of which is to be received in an electric wire receiving space 22 of the junction box 2. According to this embodiment, the electrical connection unit, as will be later explained, acts as a noise filter which blocks noise interference that would otherwise travels through the electric wire 4. The electrical connection unit is secured to a mating component of a body of an automobile for ground connection.

As illustrated in FIG. 1, the capacitor 3 is a known component that has a cushion-shaped body 31 and a pair of terminals 32 and 33. The capacitor 3 is accommodated in the junction box 2 under a condition where there is no rattling due to vibration of the automobile. The terminal 32 is electrically connected to the electric wire 4 illustrated in FIG. 3. The terminal 33 is electrically connected to a grounding member 12 (to be later described). Since the terminal 33 is a terminal dedicated to ground connection, and is defined as a grounding terminal according to the present invention. For clarity, the terminal 33 will be hereafter called "grounding terminal 33."

As a non-limiting example, the capacitor is used as the electronic component incorporated in the junction box 2. It is possible to use an electronic component other than the capacitor, such as a diode and a resistor.

The electric wire 4 may be an independent wire or one of the electric wires that belong to a wiring harness. The electric wire 4 includes a conductor 41 and an insulating sheath 42 that covers the conductor 41. As will be later described in detail, a terminal for the electric wire (hereafter called "electric wire terminal 15") is electrically connected to an intermediate portion of the electric wire 4. To be more specific, the electric wire terminal 15 is electrically connected to the conductor 41 exposed to an outside at the intermediate portion of the electric wire 4 with the sheath 42 taken away to a predetermined degree.

Still referring to FIG. 1, the junction box 2 includes a body 11, a grounding member 12, a mounting unit 13, a bus bar 14, the electric wire terminal 15, and an electric wire cover 16.

The body 11 is substantially box-shaped and made of an insulating synthetic resin. The body 11 includes an electronic component accommodating space 21 and an electric wire receiving space 22. The electronic component accommodating space 21 is configured to accommodate the capacitor 3 therein through an opening 21*a*. The electric wire receiving space 22 is configured to receive the electric wire 4 which is to be electrically connected to the terminal 32 of the capacitor 3 accommodated in the electronic component accommodating space 21.

An inner space of the body 11 is formed by a bottom wall 23 and side walls 24 that extend upright from an edge of the bottom wall 23. The inner space of the body 11 is divided by a dividing wall 25 to provide two neighboring spaces, i.e., the electronic component accommodating space 21 and the electric wire receiving space 22. Edges of the side walls 24 and an edge of the dividing wall 25 form the opening 21*a* of the electronic component accommodating space 21. Adjacent to the opening 21*a*, an opening 22*a* of the electric wire receiving space 22 is formed by the edges of the side walls 24 and the edge of the dividing wall 25.

A first body locking portion 26 of the body is formed on the side wall 24 from which the dividing wall 25 extends perpendicularly toward the opposite side wall 24 to form the opening 21*a* of the electronic component accommodating space 21. Likewise, a second body locking portion 27 is formed on the opposite side wall 24.

As illustrated in FIGS. 1 to 3, the first body locking portion 26 has, by way of example, a base surface 26*a*, a protrusion 26*b*, a pair of guiding portions 26*c*, and a pair of slits 26*d*. The base surface 26*a* is a recessed portion of the side wall 24 that has a depth corresponding to a thickness of a locking portion of the grounding member 12. The protrusion 26*b* protrudes outwardly from the base surface 26*a*. The pair of guiding portions 26*c* are edges that extend in a height direction of the base surface 26*a* (i.e., a vertical direction in FIG. 1). The pair of slits 26*d* are formed on the base surface 26*a*, extending from an upper edge of the base surface 26*a* toward a bottom side of the body such that the protrusion 26*b* resides between the slits 26*d*. Thus, the first body locking portion 26 has the flexibly bendable base surface 26*a* with the protrusion 26*b* and the pair of slits 26*d*.

Figure 4A:
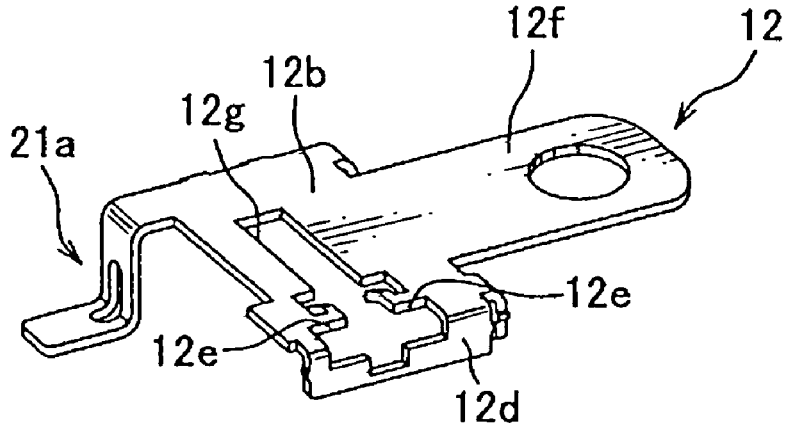
FIG. 4A is an exploded perspective view of a body of the electrical junction box incorporating an electronic component of FIG. 1.
Figure 4B:
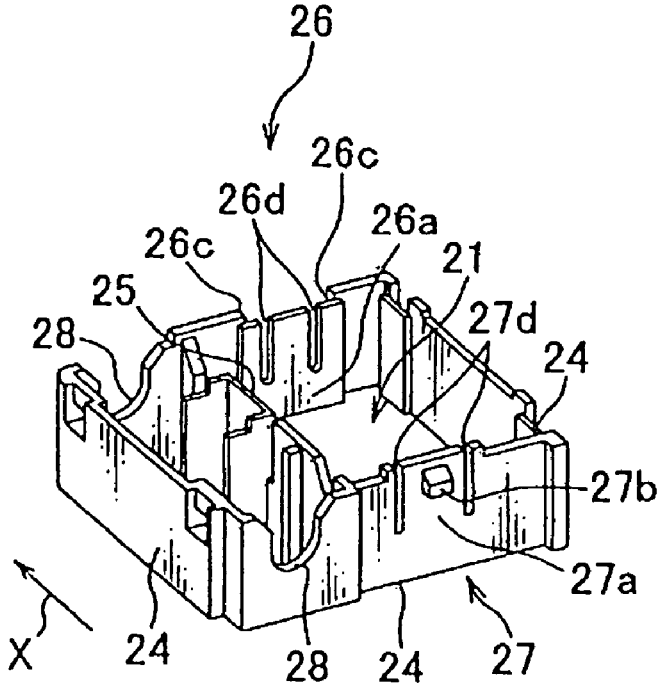
FIG. 4B is an exploded perspective view of a grounding member of the electrical junction box incorporating an electronic component of FIG. 1.

Referring to FIG. 4, the second body locking portion 27 has a base surface 27*a*, a protrusion 27*b*, and a pair of slits 27*d*. The protrusion 27*b* outwardly protrudes from the base surface 27*a*. The pair of slits 27*d* are formed on the base surface 27*a*, extending from an upper edge of the base surface 27*a* such that the protrusion 27*b* resides between the slits 27*d*. Thus, the second body locking portion 27 has the flexibly bendable base surface 27*a* with the protrusion 27*b* and the slits 27*d*.

Referring again to FIGS. 1 to 3, the grounding member 12 is made of an electrically conductive metal plate and configured to be electrically connected to (a) the grounding terminal 33 of the capacitor 3 and (b) the mating component (not shown) of the automobile body in order to ground the grounding terminal 33. The grounding member 12 is a noise filter that grounds the electric wire 4 via the capacitor 3.

The grounding member 12 has in one piece therewith a connecting portion 12*a*, a cover portion 12*b*, first and second grounding member locking portions 12*c* and 12*d*, respectively, a bending preventing portion 12*e*, and a grounding portion 12*f*. These portions are integral with the grounding member 12.

The connecting portion 12*a* is formed substantially in an L-shape. The connecting portion 12*a* extends from an edge of the cover portion 12*b*, such that the connecting portion 12*a* is located above the grounding terminal 33 that extends into the electric wire receiving space 22 out of the electronic component accommodating space 21. The connecting portion 12*a* includes a vertical portion 121 and a connecting tab 122. The vertical portion 121 is at right angles to the connecting tab 122 and extends parallel to the dividing wall 25 of the body 11. The connecting tab 122 is parallel to the bottom wall 23 of the body 11. The connecting tab 122 is electrically connected to the grounding terminal 33 of the capacitor 3 for example by welding or soldering.

The cover portion 12*b* has a shape substantially identical with that of the opening 21*a* of the electronic component accommodating space 21. The cover portion 12*b* serves as a closure lid that closes the opening 21*a* so as to lock the body with the grounding member 12. The cover portion 12*b* has a mounting portion 12*g* in a shape of a slit that is brought into engagement with the mounting unit 13 (to be later described). The mounting portion 12*g* is configured to detachably engage the mounting unit 13 when the opening 21 a of the electronic component accommodating space 21 is yet to be covered by the cover portion 12*b* of the connecting portion 12*a*. Also, the mounting portion 12*g* is configured to make the mounting unit 13 abut against an inner surface of the electronic component accommodating space 21 so that the body 11 is not accidentally detached from the grounding member 12 engaged with the mounting unit 13 when the opening 21*a* of the electronic component accommodating space 21 has been closed by the cover portion 12*b*, i.e., when the body 11 has been locked with the grounding member 12. To be more specific, the mounting portion 12*g* is a slit that extends from the second grounding member locking portion 12*d*, past the center of the cover portion 12*b*, and toward the first grounding member locking portion 12*c* so that the mounting unit 13 can be slid in a direction parallel to the dividing wall 25 of the body 11.

Figure 5A:
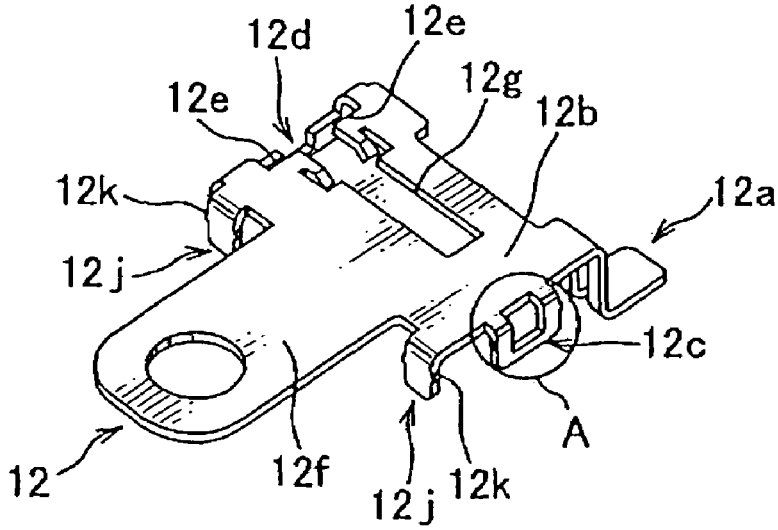
FIG. 5A is a perspective view of the grounding member of the electrical junction box incorporating an electronic component of FIG. 1, which is viewed from an opposite side in FIG. 1.

The first grounding member locking portion 12*c*, as illustrated in FIG. 5A, is a substantially U-shaped extending portion. The first grounding member locking portion 12*c* is formed at the edge of the cover portion 12*b* and extends downward along the side wall 24 of the body 11. The first grounding member locking portion 12*c* is configured to be engaged with the protrusion 26*b* of the first body locking portion 26. Movement of the first grounding member locking portion 12*c* is regulated by the guiding portions 26*c* of the first body locking portion 26 for accurate positioning of the first grounding member locking portion 12*c*.

Figure 5B:
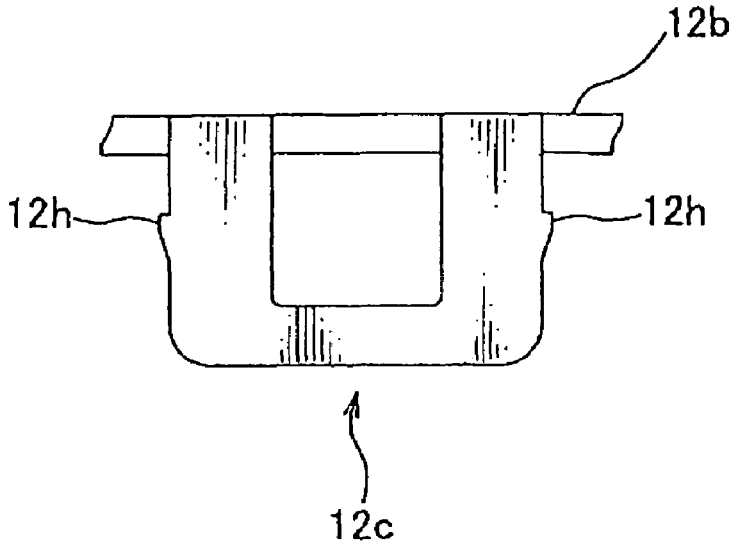
FIG. 5B is an enlarged front view of a section indicated by the circle A of FIG. 5A.

The first grounding member locking portion 12*c*, as illustrated in FIG. 5B, has a press-fitted projection 12*h* that protrudes outwardly from an outer edge of the first grounding member locking portion 12*c*. The press-fitted projection 12*h* is configured to abut against the guiding portion 26*c* so as to prevent rattling of the first grounding member locking portion 12*c* that has been engaged with the first body locking portion 26. Note that, this embodiment envisages a case where the first grounding member locking portion 12*c* is brought into engagement with the first body locking portion 26 while, by virtue of the press-fitted projection 12*h*, rattling due to vibration of the automobile is prevented. Nevertheless, if the electrical connection unit 1 is designed for use in an environment where no vibration is expected or effect of the vibration is negligible, the first grounding member locking portion 12*c* will not need to have the press-fitted projection 12*h*.

It should be noted that the press-fitted projection 12*h* is an abutting portion of the present invention.

Figure 6:
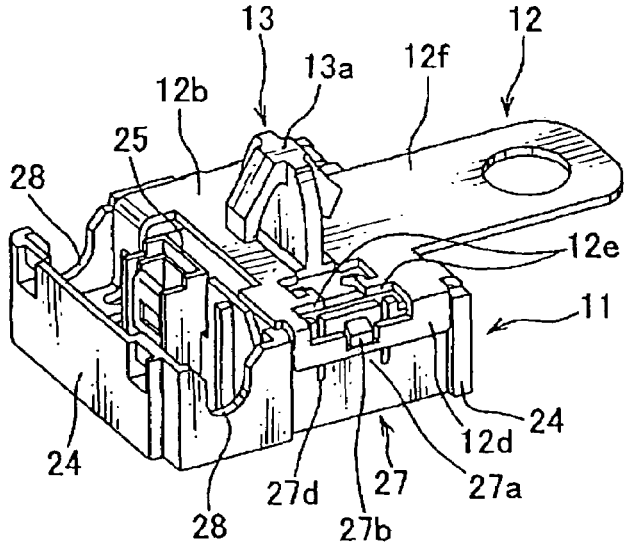
FIG. 6 is a perspective view of a body of the electrical junction box incorporating an electronic component, to which the grounding member is attached.

The second grounding member locking portion 12*d*, as illustrated in FIGS. 4 to 6, is a substantially U-shaped extending portion. The second grounding member locking portion 12*d* is formed at the edge of the cover portion 12*b* and extends along the side wall 24 of the body 11. The second grounding member locking portion 12*d* is configured to engage the protrusion 27*b* of the second body locking portion 27. The second grounding member locking portion 12*d* has a press-fitted projection 12*d*1 similar to the press-fitted projection 12*h*.

Still referring to FIGS. 4 to 6, the bending preventing portion 12*e* prevents the second body locking portion 27 from bending in a direction X. The direction X is a direction in which the second grounding member locking portion 12*d* of the grounding member 12 may be accidentally taken out of engagement with the body 11. More specifically, when the cover portion 12*b* of the grounding member 12 is engaged with the electronic component accommodating space 21, the bending preventing portion 12*e* abuts against the inner surface of the side wall 24 of the body 11 so as to prevent movement of the second body locking portion 27 in the direction X.

Figure 7:
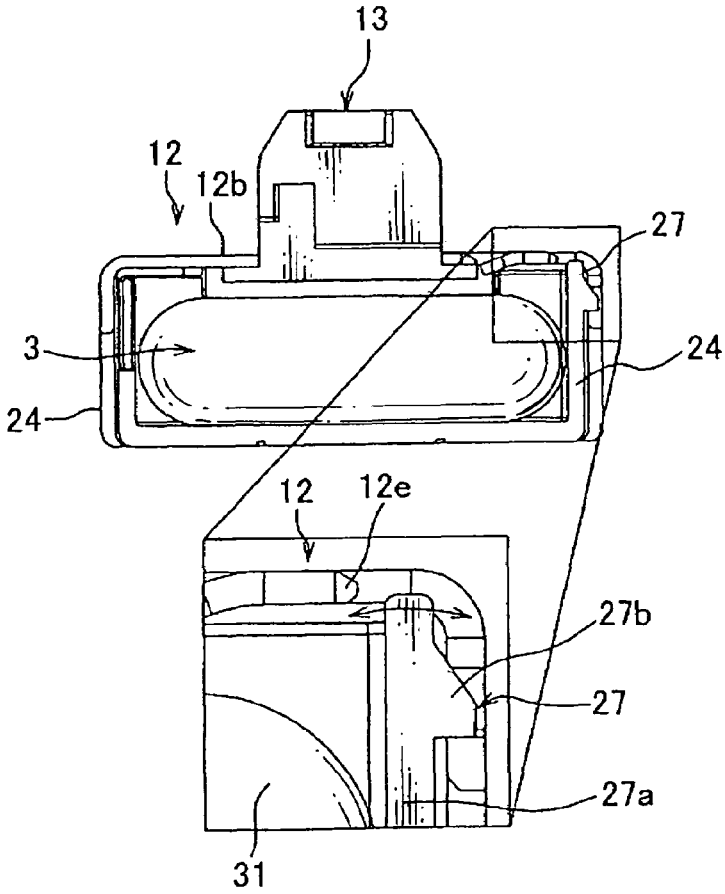
FIG. 7 illustrates an enlarged cross-section taken along the line A-A of FIG. 2 for explaining a state where mounting of the grounding member has been started.
Figure 8:
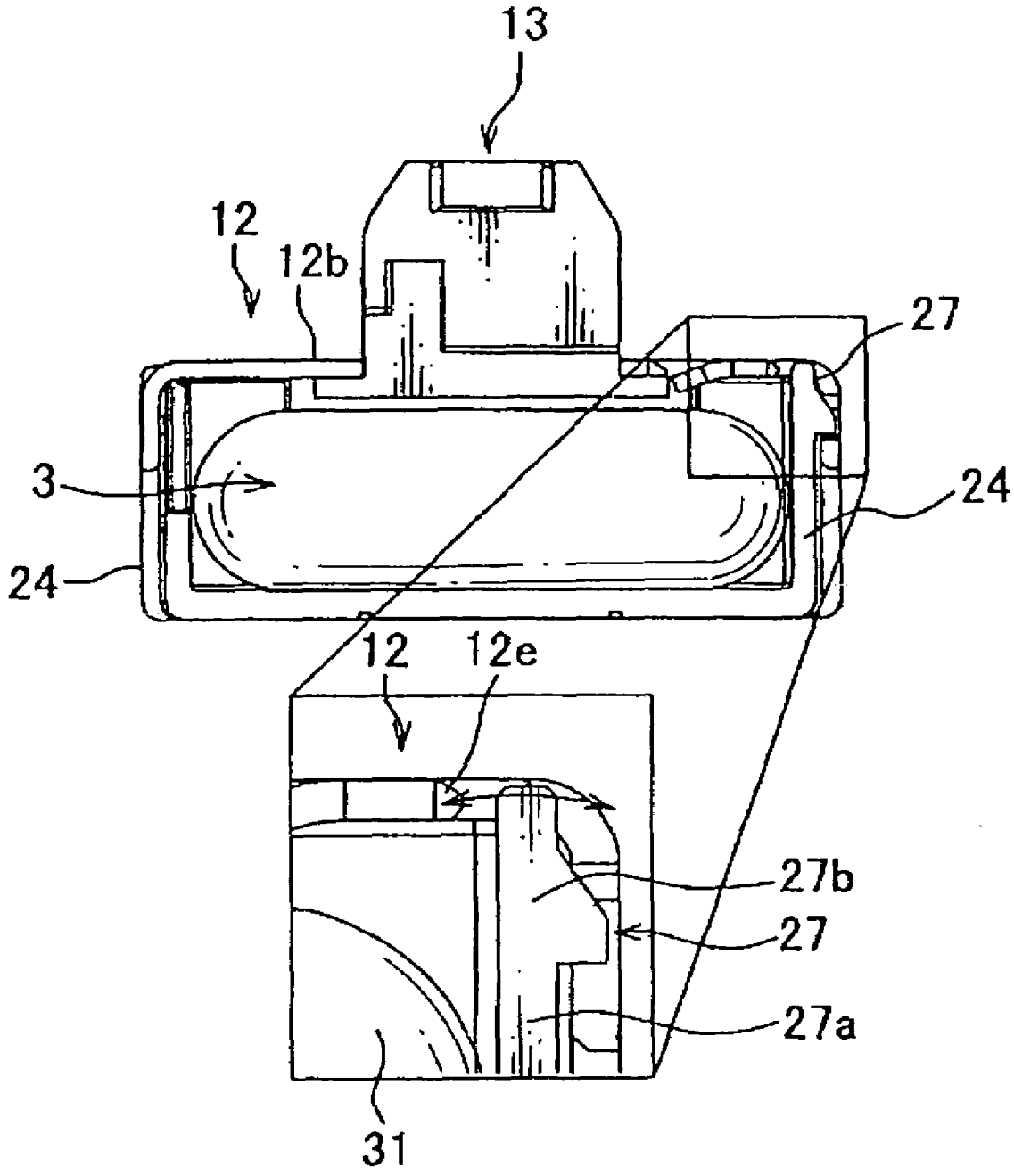
FIG. 8 illustrates an enlarged cross-section taken along the line A-A of FIG. 2 for explaining a state of the body to which the grounding member has been completely attached.

Referring further to FIG. 7, the bending preventing portion 12*e* allows the second body locking portion 27 to flexibly bend in the direction X while the second body locking portion 27 of the body 11 and the second grounding member locking portion 12*d* of the grounding member 12 are yet to be engaged with each other. Meanwhile, as illustrated in FIG. 8, the bending preventing portion 12*e* prevents the second body locking portion 27 from flexibly bending in the direction X when the second body locking portion 27 has been engaged with the second grounding member locking portion 12*d*.

The second body locking portion 27 of the body 11 and the second grounding member locking portion 12*d* of the grounding member 12, while the junction is assembled, are not affected by presence of the bending preventing portion 12*e*. When the grounding member 12 is pressed until reaching a state indicated by FIG. 8 where the grounding member 12 has been fully and completely locked with the body 11, the bending preventing portion 12*e* is located in a position in which the bending preventing portion 12*e* abuts against the second body locking portion 27. In this manner, accidental exit from the state of locking between the grounding member 12 and the body 11 can be effectively prevented by virtue of the bending preventing portion 12*e* that restricts inward bending of the second body locking portion 27.

The grounding portion 12*f* has a through-hole for a mounting screw. The grounding portion 12*f* is screwed onto the mating component of the automobile body. In this manner, the connecting portion 12*a* is grounded via the cover portion 12*b*, and therefore the electric wire 4 that has been electrically connected to the connecting portion 12*a* is also grounded.

A pair of pawls 12*j* are formed at both sides of the grounding portion 12*f*, as illustrated in FIG. 5A. Each pawl 12*j* extends perpendicularly downward from the cover portion 12*b*, and is configured to be engaged with a pawl-receiving portion 29 of the side wall 24 of the body 11. Each pawl 12*j* has a press-fitted projection 12*k* similar to the press-fitted projection 12*h*.

The mounting unit 13 is used to secure the junction box 2, and therefore the electrical connection unit to the mating component of the automobile. The mounting unit 13 may take a shape other than that illustrated in FIG. 1. The mounting unit 13 has a locking projection 13*a* and a base 13*b*. The locking projection 13*a* is configured to mount the junction box 2 to the mating component. The base 13*b* provides a space for slidably sandwiching the mounting portion 12*g* (of the cover portion 12*b*) between the base 13*b* and the locking projection 13*a*. The mounting unit 13 is inserted into the mounting portion 12*g* of the cover portion 12*b* from the side of the second grounding member locking portion 12*d* so as to be slid toward the center of the cover portion 12*b*, and the mounting unit 13 is engaged with and retained by the mounting portion 12*g*.

The bus bar 14 is an electrically conductive metal in a shape illustrated in FIG. 1. The bus bar 14 includes in one piece therewith a base 14*a*a plurality of bus bar locking portions 14*b*and an upstanding portion 14*c*. The base 14*a* is configured to be accommodated in the electric wire receiving space 22 so as to be electrically connected to the terminal 32 of the capacitor 3. The bus bar locking portion 14*b* protrudes downward from the base 14*a* and secures the bus bar 14 to the body 11. The two bus bar locking portions 14*b* are illustrated in FIG. 1. The upstanding portion 14*c* stands upright on the base 14*a* in a direction parallel to the dividing wall 25 of the body 11. The upstanding portion 14*c* is electrically connected to the electric wire terminal 15. These three portions are integral with the bus bar 14.

The electric wire terminal 15 is made of an electrically conductive metal material in such a shape as illustrated in FIG. 1. The electric wire terminal 15 has an electric wire connecting portion 15*a*, a continuing part 15*b*, and a contacting part 15*c*. The electric wire connecting portion 15*a* is directly connected to the conductor 41 exposed out of the sheath 42 of the electric wire 4. The continuing part 15*b* continues to the electric wire connecting portion 15*a*. The contacting part 15*c* extends from a side of the continuing part 15*b* and configured to be electrically connected to the upstanding portion 14*c* of the bus bar 14.

The electric wire cover 16 is made of an insulating synthetic resin. The electric wire cover 16 presses the electric wire terminal 15 that has been received in the electric wire receiving space 22 and closes the opening 22*a*. The electric wire cover 16 has a top wall 16*a*, a pair of side walls 16*b*, a guiding portion 16*c*, a protrusion 16*d*, and an electric wire locking portion 16*e*. The pair of side walls 16*b* extend from a surface of the top wall 16*a*. The guiding portion 16*c* is formed on an outer surface of the side wall 16*b* and configured to guide and regulate the insertion of the electric wire cover 16 into the electric wire receiving space 22. The protrusion 16*d* of the electric wire cover 16 fits into a mating hole 24*a* of the side wall 24 which defines the electric wire receiving space 22. The electric wire locking portion 16*e* is formed between the pair of side walls 16*b* and configured to retain the electric wire 4.

A pair of mutually opposing electric wire supporting portions 28 in a U-shaped indentation are formed from an edge of the side wall 24 such that each of the electric wire supporting portions 28 is configured to register with the electric wire locking portion 16*e*. The electric wire supporting portion 28 is configured to hold the electric wire 4 that has been inserted during an assembling process. The electric wire 4 is pressed and retained by the electric wire locking portion 16*e* of the electric wire cover 16, and thus the electric wire 4 is secured to the junction box 2.

Given the above-defined construction and arrangement, the following describes how the electrical connection unit 1 is assembled according to the embodiment of the present invention.

First, the capacitor 3 is accommodated in the electronic component accommodating space 21. The capacitor 3 is inserted via the opening 21*a* of the electronic component accommodating space 21 with the terminals 32 and 33 extending into the electric wire receiving space 22. Likewise, the bus bar 14 has to be accommodated in the electric wire receiving space 22. The bus bar 14 is inserted in the electric wire receiving space 22 and secured to the body 11. Further, the mounting unit 13 is coupled to the cover portion 12*b* of the grounding member 12. More specifically, the mounting unit 13 is inserted into the mounting portion 12*g* of the grounding member 12 and slid until it is positioned at the center of the cover portion 12*b*.

Figure 9A:
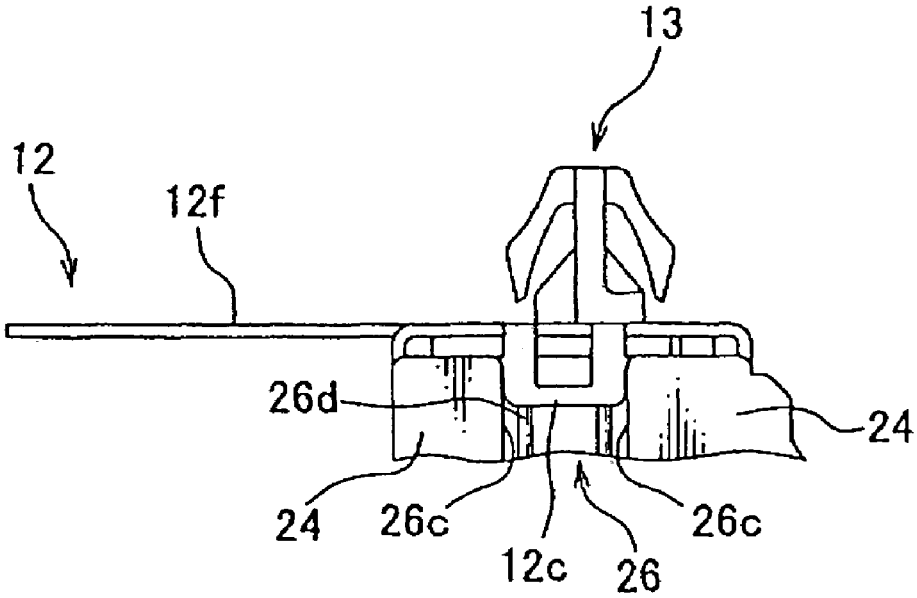
FIG. 9A illustrates a state where the grounding member is being attached to the body.
Figure 9B:
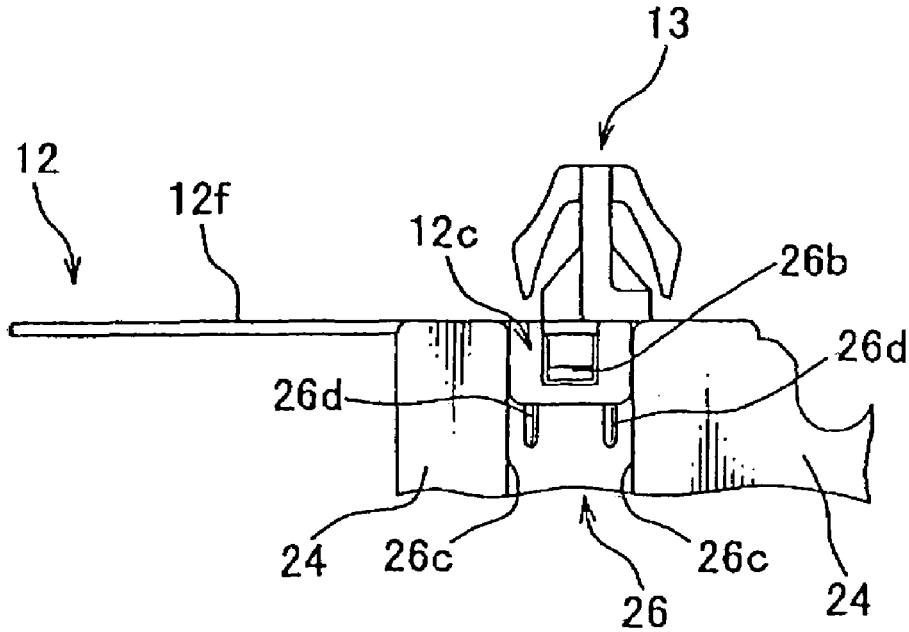
FIG. 9B illustrates a state where the grounding member has been attached to the body.

The grounding member 12 is moved close to the body 11 until the opening 21*a* of the electric wire receiving space 22 is fully closed. As illustrated in FIG. 9A, a tapering surface of the press-fitted projections 12*h* formed on the first grounding member locking portion 12*c* is guided by the pair of guiding portions 26*c*, the second grounding member locking portion 12*d* is guided by the second body locking portion 27, and the grounding member 12 is positioned in register with the electric wire receiving space 22, and the grounding member 12 is pressed toward the body 11. Thus, the first grounding member locking portion 12*c* is engaged with the first body locking portion 26, and the second grounding member locking portion 12*d* is locked with the second body locking portion 27 (see FIG. 9B). At this point, the press-fitted projections 12*h* of the first grounding member locking portion 12*c* both abuts against the guiding portions 26*c* of the first body locking portion 26. The bending preventing portion 12*e* blocks the movement of second body locking portion 27 in the direction X when the second body locking portion 27 is engaged with the locking portion 12*d*, and thus the bending of the locking portion 27 is prevented (see FIG. 8). Also, the bus bar 14 and the connecting portion 12*a* of the grounding member 12 both reside above the grounding terminal 33 of the capacitor 3. The bus bar 15, the connecting portion 12*a*, and the grounding terminal 33 are electrically connected for example by welding or soldering.

The sheath 42 of the electric wire 4 is removed in a predetermined degree at an intermediate portion of the electric wire 4 as a desired position so that the conductor 41 is exposed to an outside. The electric wire terminal 15 is press-fitted such that the exposed conductor 41 is covered by the electric wire connecting portion 15*a* of the electric wire terminal 15, and thus the conductor 41 is electrically connected to the electric wire terminal 15. The electric wire terminal 15 is then inserted into the electric wire cover 16, and the electric wire cover 16 is, in turn, inserted into the electric wire receiving space 22 such that the electric wire cover 16 covers the opening 22*a*. Finally, the electric wire 4 is received in the electric wire receiving space 22 with the electric wire 4 and the bus bar 14 electrically connected to each other via the electric wire terminal 15.

The mounting unit 13 of the electrical connection unit 1 is inserted into a mounting hole of the mating component so as to be temporarily secured, and the through-hole of the grounding portion 12*f* of the grounding member 12 and the screw hole of the mating component are registered with each other and secured by a screw. As has already been mentioned, the electrical connection unit 1 functions as the noise filter.

According to the electrical connection unit 1 that has been fully discussed in the foregoing, the capacitor (electronic component) 3 accommodated in the electronic component accommodating space 21 of the body 11 of the electrical junction box 2 is electrically connected to the electric wire 4 received in the electric wire receiving space 22, and the capacitor 3 is electrically connected to the grounding member 12. The first and second grounding member locking portions 12*c* and 12*d* are provided such that the cover portion 12*b* of the grounding member 12 covers the opening 21*a* of the electronic component accommodating space 21. The bending preventing portion 12*e* of the grounding member 12 prevents the second body locking portion 27 from bending in the direction X. By this configuration, the accidental exit from the state of locking between the body 11 and the grounding member 12 can be effectively prevented even when an external force is applied to the locking mechanism of the grounding member 12 and the body 11. This means that the grounding member 12 is protected against being detached from the body 11. Also, because the grounding member 12 is made of an electrically conductive metal, mechanical strength of the bending preventing portion 12*e* can be reinforced, and the accidental exit from the state of locking due to the external force can be more securely prevented. Accordingly, it is possible not only to provide the reliable mechanical locking mechanism between the grounding member 12 and the body 11 regardless of the external force but also to prevent the electrical disconnection among the grounding member 12, the capacitor 3, and the electric wire 4, and thus the noises that travels through the electric wire 4 can be effectively eliminated.

In addition, when the grounding member 12 is locked with the body 11 such that the opening 21 a of the electronic component accommodating space 21 is closed, the detachable mounting unit 13 abuts against the electronic component accommodating space 21 so that the body 11 is protected against being accidentally detached from the grounding member 12, which not only makes the locking mechanism more reliable but also makes the assembly operation more efficient.

Further, by virtue of the guiding portion 26*c* of the body 11, the first grounding member locking portion 12*c* of the grounding member 12 is guided to the first body locking portion 26, and therefore failure to lock the grounding member 12 with the body 11 can be avoided and the reliability of electrical connection is improved. Also, since the grounding member 12 has the press-fitted projection 12*h* that abuts against the guiding portion 26*c* when the first grounding member locking portion 12*c* and the first body locking portion 26 have been locked with each other, it is possible to prevent occurrence of the rattling of the body 11 and the grounding member 12 and strange or unusual sound due to vibration while the automobile is moving.

In addition, as the first grounding member locking portion 12*c* and the first body locking portion 26 come close to each other, the first grounding member locking portion 12*c* and the first body locking portion 26 are guided to a locking position by the tapering surface of the press-fitted projection 12*h*. Accordingly, even when individual components are subject to manufacturing tolerance, tolerance stack-up can be absorbed by the tapering surface of the press-fitted projection 12*h*. This allows the first grounding member locking portion 12*c* and the first body locking portion 26 to be guided with accuracy.

Further, resilient bending of the second body locking portion 27 in the direction in which the second grounding member locking portion 12*d* may be accidentally taken out of engagement with the body 11 can be prevented by the bending preventing portion 12*e* only when the second body locking portion 27 is locked with the second grounding member locking portion 12*d*, which makes the assembly operation more efficient.

Having now fully described the invention, it is clear that the foregoing is illustrative of the present invention and is not to be construed as limiting the invention. Those skilled in this art will readily effectuate possible modifications and variations without materially departing from the spirit and scope of the present invention.

What is claimed is:

1. An electrical junction box incorporating an electronic component comprising:

a body that includes an electronic component accommodating space that accommodates the electronic component therein via an opening, and an electric wire receiving space adapted and configured to receive therein an electric wire that is electrically connectable to a terminal of the electronic component accommodated in the electronic component accommodating space; and an electrically conductive grounding member that grounds a grounding terminal of the electronic component and includes in one piece therewith:

a connecting portion that is electrically connected to the grounding terminal of the electronic component;

a cover portion that covers the opening of the electronic component accommodating space;

first and second grounding member locking portions that are locked with a first and second body locking portions of the body, respectively, in order that the cover portion is locked with the body;

a bending preventing portion that prevents the second body locking portion from resiliently bending in a detachment direction in which the second grounding member locking portion is detached from the second body locking portion; and a grounding portion for grounding the connecting portion.

2. The electrical junction box incorporating an electronic component as set forth in claim 1, further comprising a mounting unit that is detachably attached to the cover portion of the grounding member, wherein the cover portion of the grounding member has a mounting hole to which the mounting unit is detachably attached when the opening of the electronic component accommodating space is yet to be covered by the cover portion of the grounding member, and the mounting hole is configured to make the mounting unit abut against an inner wall of the electronic component accommodating space so as to prevent the grounding member from being accidentally detached from the body when the opening of the electronic component accommodating space has been covered by the cover portion of the grounding member.

3. The electrical junction box incorporating an electronic component as set forth in claim 1, wherein the body further includes a guiding portion that guides the first grounding member locking portion to the first body locking portion, and the grounding member further includes an abutting portion that abuts against the guiding portion of the body when the first grounding member locking portion is locked with the first body locking portion.

4. The electrical junction box incorporating an electronic component as set forth in claim 1, wherein the bending preventing portion of the grounding member is configured such that the second body locking portion is allowed to resiliently bend in the detachment direction until the second body locking portion of the body is locked with the second grounding member locking portion, and the second body locking portion is prevented from resiliently bending in the detachment direction when the second grounding member locking portion has been locked with the second body locking portion.

* * * * *